US010415126B2

(12) United States Patent
Nakamura et al.

(10) Patent No.: US 10,415,126 B2
(45) Date of Patent: Sep. 17, 2019

(54) FERRITIC STAINLESS STEEL

(71) Applicant: JFE STEEL CORPORATION, Tokyo (JP)

(72) Inventors: Tetsuyuki Nakamura, Chiba (JP); Hiroki Ota, Handa (JP); Chikara Kami, Kurashiki (JP)

(73) Assignee: JFE STEEL CORPORATION, Tokyo (JP)

( * ) Notice: Subject to any disclaimer, the term of this patent is extended or adjusted under 35 U.S.C. 154(b) by 369 days.

(21) Appl. No.: 15/310,970

(22) PCT Filed: May 12, 2015

(86) PCT No.: PCT/JP2015/002406
§ 371 (c)(1),
(2) Date: Nov. 14, 2016

(87) PCT Pub. No.: WO2015/174078
PCT Pub. Date: Nov. 19, 2015

(65) Prior Publication Data

US 2017/0073799 A1 Mar. 16, 2017

(30) Foreign Application Priority Data

May 14, 2014 (JP) ..... 2014-100345

(51) Int. Cl.

| | |
|---|---|
| ***C22C 38/54*** | (2006.01) |
| ***C22C 38/02*** | (2006.01) |
| ***C22C 38/04*** | (2006.01) |
| ***C22C 38/06*** | (2006.01) |
| ***C22C 38/34*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C21D 9/46*** | (2006.01) |
| ***C22C 38/00*** | (2006.01) |
| ***C21D 6/00*** | (2006.01) |
| *C21D 8/02* | (2006.01) |

(52) U.S. Cl.
CPC ..... *C22C 38/54* (2013.01); *C21D 6/004* (2013.01); *C22C 38/00* (2013.01); *C22C 38/001* (2013.01); *C22C 38/002* (2013.01); *C22C 38/004* (2013.01); *C22C 38/005* (2013.01); *C22C 38/02* (2013.01); *C22C 38/04* (2013.01); *C22C 38/06* (2013.01); *C22C 38/34* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C21D 8/0205* (2013.01); *C21D 9/46* (2013.01)

(58) Field of Classification Search
None
See application file for complete search history.

(56) References Cited

U.S. PATENT DOCUMENTS

| | | | | |
|---|---|---|---|---|
| 9,365,915 | B2 * | 6/2016 | Nakamura | C22C 38/54 |
| 2004/0170518 | A1 * | 9/2004 | Oku | C22C 38/004 420/60 |
| 2012/0014830 | A1 * | 1/2012 | Hamada | C22C 38/001 420/61 |
| 2012/0020827 | A1 * | 1/2012 | Nakamura | C22C 38/001 420/39 |
| 2013/0306204 | A1 * | 11/2013 | Teraoka | C22C 38/54 148/603 |
| 2013/0319583 | A1 * | 12/2013 | Hatano | C22C 38/06 148/602 |
| 2014/0241931 | A1 | 8/2014 | Nakamura et al. | |
| 2014/0294661 | A1 * | 10/2014 | Fukuda | C21D 9/46 420/61 |
| 2016/0168673 | A1 * | 6/2016 | Yoshino | C22C 38/54 420/38 |
| 2016/0281189 | A1 * | 9/2016 | Fujisawa | C22C 38/54 |
| 2016/0333439 | A1 * | 11/2016 | Yoshino | C22C 38/54 |

(Continued)

FOREIGN PATENT DOCUMENTS

| | | | |
|---|---|---|---|
| CN | 102471841 | A | 5/2012 |
| CN | 103403205 | A | 11/2013 |
| EP | 1930461 | A1 | 6/2008 |

(Continued)

OTHER PUBLICATIONS

English translation of the Written Opinion of the International Search Authority dated Jul. 21, 2015 for PCT/JP2015/002406; 4 pages.*
English translation of JP 2001/185413, Jul. 2001; 13 pages.*
Feb. 13, 2017 Search Report issued in European Patent Application No. 15792676.7.
Mar. 7, 2018 Office Action issued in European Patent Application No. 15 792 676.7.
Aug. 28, 2017 Office Action issued in Chinese Patent Application No. 201580025046.1.
Jul. 21, 2015 International Search Report issued in PCT/JP2015/002406.
Dec. 27, 2018 Office Action issued in Chinese Patent Application No. 201580025046.1.

(Continued)

*Primary Examiner* — Helene Klemanski
(74) *Attorney, Agent, or Firm* — Oliff PLC

(57) ABSTRACT

A ferritic stainless steel having excellent thermal fatigue resistance, excellent oxidation resistance, and excellent high-temperature fatigue resistance is provided. The ferritic stainless steel contains, in terms of % by mass, C: 0.020% or less, Si: 3.0% or less, Mn: 2.0% or less, P: 0.040% or less, S: 0.030% or less, Cr: 10.0% to 20.0%, N: 0.020% or less, Nb: 0.005% to 0.15%, Al: 0.20% to 3.0%, Ti: 5× (C+N)% to 0.50%, Cu: 0.55% to 1.60%, B: 0.0002% to 0.0050%, Ni: 0.05% to 1.0%, 0: 0.0030% or less, and the balance being Fe and unavoidable impurities. Additionally, the ferritic stainless steel satisfies that Al/O≥100.

8 Claims, 2 Drawing Sheets

(56) References Cited

U.S. PATENT DOCUMENTS

| | | | | |
|---|---|---|---|---|
| 2017/0183752 | A1* | 6/2017 | Fukuda | C21D 9/46 |
| 2017/0266751 | A1* | 9/2017 | Hirasawa | C22C 38/06 |

FOREIGN PATENT DOCUMENTS

| | | | |
|---|---|---|---|
| EP | 2 474 635 | A1 | 7/2012 |
| EP | 2 677 055 | A1 | 12/2013 |
| JP | H04-173939 | A | 6/1992 |
| JP | H8 109443 | A | 4/1996 |
| JP | 2001-185413 | A | 7/2001 |
| JP | 2006-193789 | A | 7/2006 |
| JP | 2008-138270 | A | 6/2008 |
| JP | 2009-068113 | A | 4/2009 |
| JP | 2010-248620 | A | 11/2010 |
| JP | 2012-193435 | A | 10/2012 |
| JP | 2013-100595 | A | 5/2013 |
| JP | 2013-209706 | A | 10/2013 |
| JP | 2013-227659 | A | 11/2013 |
| WO | 2011/096454 | A1 | 8/2011 |
| WO | 2013/054524 | A1 | 4/2013 |
| WO | 2014/050011 | A1 | 4/2014 |
| WO | WO 2016/017053 | A1 * | 2/2016 |

OTHER PUBLICATIONS

Jun. 5, 2018 Office Action issued in Chinese Patent Application No. 201580025046.1.

Jun. 14, 2019 Office Action issued in Chinese Patent Application No. 201580025046.1.

* cited by examiner

FERRITIC STAINLESS STEEL

TECHNICAL FIELD

The present disclosure relates to a ferritic stainless steel that has an excellent thermal fatigue resistance, an excellent high-temperature fatigue resistance, and excellent oxidation resistance. The ferritic stainless steel according to the present disclosure is suitable for use in exhaust parts in high-temperature environments, such as exhaust pipes and catalyst cases (also known as converter cases) of automobiles and motorcycles and exhaust ducts of thermal power plants.

BACKGROUND ART

Exhaust-system components such as exhaust manifolds, exhaust pipes, converter cases, and mufflers used in an automobile exhaust system environment are required to have an excellent thermal fatigue resistance, an excellent high-temperature fatigue resistance, and excellent oxidation resistance (hereinafter these properties may be generally referred to as a "heat resistance"). Currently, Cr-containing steels such as steels containing Nb and Si (for example, JFE 429EX (15 mass % Cr-0.9 mass % Si-0.4 mass % Nb) (hereinafter may be referred to as Nb—Si-containing steel)) are often used in applications that require such a heat resistance. In particular, a Cr-containing steel that contains Nb is known to exhibit an excellent heat resistance. However, since the raw material cost for Nb is high, addition of Nb increases the steel manufacturing cost. From the viewpoint of manufacturing cost, development of a steel that exhibits a high heat resistance with a minimum amount of Nb added is required.

To address this issue, Patent Literature 1 discloses a stainless steel sheet whose heat resistance is enhanced by adding Ti, Cu, and B.

Patent Literature 2 discloses a stainless steel sheet whose workability is enhanced by addition of Cu.

Patent Literature 3 discloses a heat-resistant ferritic stainless steel sheet whose heat resistance is enhanced by addition of Ti.

Patent Literature 4 discloses a heat-resistant ferritic stainless steel sheet whose heat resistance is enhanced by addition of Nb, Cu, Ti, Ni, and Al.

CITATION LIST

Patent Literature

PTL 1: Japanese Unexamined Patent Application Publication No. 2010-248620

PTL 2: Japanese Unexamined Patent Application Publication No. 2008-138270

PTL 3: Japanese Unexamined Patent Application Publication No. 2009-68113

PTL 4: Japanese Unexamined Patent Application Publication No. 2013-100595

SUMMARY

Technical Problem

However, the technology described in Patent Literature 1 has deteriorated continuous oxidation resistance due to addition of Cu. Moreover, according to the technology described in Patent Literature 1, adhesion of oxide scale is degraded due to addition of Ti. If continuous oxidation resistance is deficient, the amount of oxide scale generated during use at high temperature increases and the thickness of the base metal decreases. Thus, an excellent thermal fatigue resistance is not obtained. If adhesion of oxide scale is low, spalling of oxide scale occurs during use, raising a problem that other components may be adversely affected.

Usually, the weight gain of oxide scale is evaluated by conducting a continuous oxidation test by which the weight gain by oxidation after the steel has been isothermally held at high temperature is determined. Adhesion of the oxide scale is usually evaluated by conducting a cyclic oxidation test in which heating and cooling are repeated to check whether spalling of oxide scale occurs. The property determined by the former test is referred to as "continuous oxidation resistance" and the property determined by the latter test is referred to as "cyclic oxidation resistance". Hereinafter, "oxidation resistance" means both continuous oxidation resistance and cyclic oxidation resistance.

According to the technology described in Patent Literature 2, since an appropriate amount of Ti is not added, C and N combine with Cr in the steel to form a Cr-depleted zone near grain boundaries, thereby causing sensitization. Once sensitization occurs, the steel no longer exhibits excellent oxidation resistance due to degraded oxidation resistance in the Cr-depleted zone, which brings a problem.

Patent Literature 3 does not disclose any example in which Cu, Ti, Ni, and B are added together. If B is not added, the grain refinement effect caused by precipitation of ε-Cu is not obtained, and a good thermal fatigue resistance is not obtained, which is a problem.

According to the technology described in Patent Literature 4, an excellent thermal fatigue resistance, an excellent oxidation resistance, and an excellent high-temperature fatigue resistance are obtained by adding Al in addition to Nb, Cu, Ti, and Ni; however, the high-temperature fatigue resistance be preferably further improved.

The present disclosure has been made to resolve the problems described above. An object of the present disclosure is to provide a ferritic stainless steel that has an excellent thermal fatigue resistance, an excellent oxidation resistance and a particularly excellent high-temperature fatigue resistance.

Solution to Problem

The inventors have conducted extensive studies on the high-temperature fatigue resistance of a steel containing Cu, Ti, Ni, and Al and found that the oxygen (O) content of the steel affects the high-temperature fatigue resistance. However, Patent Literature 4 is silent as to the O content of the steel. In the present disclosure, the influence of the O content of the steel is considered and the O content is limited to an appropriate amount, and thereby, a ferritic stainless steel sheet having an excellent thermal fatigue resistance, excellent oxidation resistance and a particularly excellent high-temperature fatigue resistance can be provided.

The "excellent thermal fatigue resistance " in the present disclosure means that the lifetime is 910 cycles or more when the cycle is repeated between 800° C. and 100° C. at a restraint ratio of 0.5. The "excellent oxidation resistance" in the present disclosure means that the weight gain by oxidation after the steel has been held in air at 1000° C. for 300 hours is less than 50 g/m$^2$ and that spalling of oxide scale does not occur after 400 cycles of heating and cooling between 1000° C. and 100° C. in air. The "particularly excellent high-temperature fatigue resistance" in the present disclosure means that fracture does not occur even when 70 MPa bending stress is repeatedly applied $100 \times 10^5$ times at 800° C.

The present disclosure has been made by conducting further studies based on the findings described above, and exemplary disclosed embodiments include as follows:

[1] A ferritic stainless steel comprising, in terms of % by mass, C: 0.020% or less, Si: 3.0% or less, Mn: 2.0% or less, P: 0.040% or less, S: 0.030% or less, Cr: 10.0% to 20.0%, N: 0.020% or less, Nb: 0.005% to 0.15%, Al: 0.20% to 3.0%, Ti: 5× (C+N)% to 0.50%, Cu: 0.55% to 1.60%, B: 0.0002% to 0.0050%, Ni: 0.05% to 1.0%, 0: 0.0030% or less, and the balance being Fe and unavoidable impurities, wherein Al/O≥100, where in 5× (C+N), C and N respectively represent a carbon content and a nitrogen content (% by mass), and in Al/O, Al and O respectively represent an aluminum content and an oxygen content (% by mass).

[2] The ferritic stainless steel according to [1] above, further comprising, in terms of % by mass, at least one element selected from the group consisting of REM: 0.005% to 0.08%, Zr: 0.01% to 0.50%, V: 0.01% to 0.50%, and Co: 0.01% to 0.50%.

[3] The ferritic stainless steel according to [1] or [2] above, further comprising, in terms of % by mass, at least one element selected from the group consisting of Ca: 0.0005% to 0.0030% and Mg: 0.0010% to 0.0030%.

[4] The ferritic stainless steel according to any one of [1] to [3] above, further comprising, in terms of % by mass, Mo: 0.05% to 1.0% or less.

Advantageous Effects

According to the present disclosure, a ferritic stainless steel that has an excellent thermal fatigue resistance, excellent oxidation resistance and a particularly excellent high-temperature fatigue resistance can be obtained with a minimal Nb content.

Since the ferritic stainless steel according to the present disclosure has an excellent thermal fatigue resistance, excellent oxidation resistance, and a particularly excellent high-temperature fatigue resistance, the ferritic stainless steel is suited for use in automobile exhaust parts.

DESCRIPTION OF EMBODIMENTS

Figure 1:
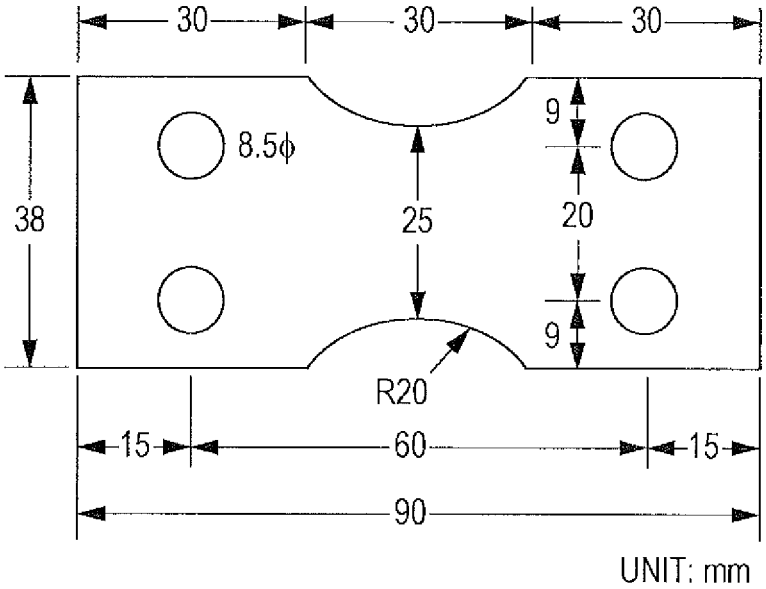
FIG. 1 is a diagram illustrating a fatigue test specimen used in a high-temperature fatigue test.

Embodiments of the present disclosure will now be described. The present disclosure is not limited to the embodiments described below.

The composition of a ferritic stainless steel according to the present disclosure is described. In the description below, "%" used to describe the amount of a component contained means "% by mass".

C: 0.020% or less

Carbon (C) is an element effective for increasing the strength of steel but a deterioration in toughness and formability is significant at a C content exceeding 0.020%. Thus, in the present disclosure, the C content is to be 0.020% or less. From the viewpoint of ensuring the formability of stainless steel, the C content is preferably as low as possible. From the viewpoint of formability, the C content is preferably 0.015% or less and more preferably 0.010% or less. In order to ensure the strength required for exhaust parts, the C content is preferably 0.001% or more and more preferably 0.003% or more.

Si: 3.0% or less

Silicon (Si) is an important element for improving oxidation resistance. This effect can be easily obtained at a Si content of 0.1% or more. If higher oxidation resistance is required, the Si content is preferably 0.3% or more. At a Si content exceeding 3.0%, not only workability is deteriorated but also a scale separation property is deteriorated. Thus, the Si content is to be 3.0% or less. The Si content is more preferably in the range of 0.4% to 2.0% and yet more preferably in the range of 0.5% to 1.0%.

Mn: 2.0% or less

Manganese (Mn) is an element that increases the strength of steel and also acts as a deoxidizer. Manganese also suppresses spalling of oxide scale that easily results from containing Si. In order to obtain such effects, the Mn content is preferably 0.05% or more. At a Mn content exceeding 2.0%, not only the weight gain by oxidation is increased significantly but also γ phase easily forms at high temperature, thereby deteriorating the heat resistance. Thus, the Mn content is to be 2.0% or less. The Mn content is preferably in the range of 0.10% to 1.0% and more preferably in the range of 0.15% to 0.50%.

P: 0.040% or less

Phosphorus (P) is a harmful element that deteriorates the toughness and the P content is preferably as low as possible. In the present disclosure, the P content is to be 0.040% or less and preferably 0.030% or less.

S: 0.030% or less

Sulfur (S) deteriorates formability by decreasing elongation or r value, and is also a harmful element that deteriorates corrosion resistance, which is the basic property of the stainless steel. Thus, the S content is preferably as low as possible. In the present disclosure, the S content is to be 0.030% or less, more preferably 0.010% or less, and yet more preferably 0.005% or less.

Cr: 10.0% to 20.0%

Chromium (Cr) is an important element effective for improving corrosion resistance and oxidation resistance, which are the features of stainless steel. At a Cr content less than 10.0%, sufficient oxidation resistance is not obtained. On the other hand, Cr is an element that causes solid solution strengthening of steel at room temperature, and thereby Cr hardens the steel and deteriorates ductility. In particular, when the Cr content exceeds 20.0%, these undesirable properties become significant. Thus, the upper limit is to be 20.0%. The Cr content is preferably in the range of 12.0% to 18.0% and more preferably in the range of 14.0% to 16.0%.

N: 0.020% or less

Nitrogen (N) is an element that deteriorates the toughness and formability of the steel. The deterioration in formability is significant if the N content exceeds 0.020%. The N content is thus to be 0.020% or less. From the viewpoints of ensuring toughness and formability of stainless steel, the N content is preferably as low as possible and is preferably 0.015% or less. As such, N is preferably not intentionally added, and stainless steel to which N is not intentionally added, in other words, stainless steel that does not contain N or that contains N as an unavoidable impurity, is a stainless steel according to the present disclosure. It takes a long refining time to decrease the N content. Thus, excessively decreasing the N content increases the manufacturing cost. In the present disclosure, the N content is preferably 0.005% or more and 0.015% or less considering the balance between toughness, formability, and manufacturing cost.

Nb: 0.005% to 0.15%

In a Cu-containing steel such as a steel of the present disclosure, Nb has an effect of improving the thermal fatigue resistance and the high-temperature fatigue resistance by causing precipitation of finer ε-Cu and suppressing coarsening of ε-Cu. This effect can be obtained at a Nb content of 0.005% or more. At a Nb content exceeding 0.15%, the recrystallization temperature of the steel increases significantly, and the annealing temperature during production must be increased, thereby increasing the manufacturing cost. Thus, the Nb content is to be in the range of 0.005% to 0.15%, preferably in the range of 0.02% to 0.12%, and more preferably in the range of 0.04% to 0.10%.

Al: 0.20% to 3.0%

Aluminum (Al) is known to be an element that contributes to improving oxidation resistance and high-temperature salt corrosion resistance of Cu-containing steels. In the present disclosure, Al is also important as an element that increases the high-temperature strength of the steel through solid solution strengthening to improve the high-temperature fatigue resistance. These effects are obtained at an Al content of 0.20% or more. On the other hand, at an Al content exceeding 3.0%, toughness of the steel is significantly deteriorated, brittle fracture easily occurs, and an excellent high-temperature fatigue resistance is not obtained. Thus, the Al content is to be in the range of 0.20% to 3.0% and preferably in the range of 0.25% to 1.0%. The Al content that strikes the best balance among the high-temperature fatigue resistance, the oxidation resistance, and the toughness is in the range of 0.30% to 0.50%.

As described below, Al is an element that easily forms oxides by combining with O. When the O content of the steel is high, Al forms oxides accordingly. As the amount of the Al oxides formed increases, the amount of Al dissolved in the steel is decreased and the solid solution strengthening is deteriorated. The Al oxides formed by Al combining with O in the steel tend to serve as starting points for cracks and thus deteriorate the high-temperature fatigue resistance. Thus, in the present disclosure, the O content in the steel is minimized to leave as much Al as possible dissolved in the steel.

Ti: 5× (C+N)% to 0.50%

Titanium (Ti), as with Nb, has an effect of fixing C and N and improving corrosion resistance, formability, and weld-zone intergranular corrosion resistance of stainless steel. In the present disclosure, since C and N can be fixed by using Ti, the Nb content can be minimized. In other words, in the present disclosure, Ti is an important element for fixing C and N. In order to obtain this effect, the Ti content needs to be 5×(C+N)% or more, where C and N in "5× (C+N)" respectively represent the C content and the N content (% by mass). At a Ti content less than this, C and N cannot be sufficiently fixed and Cr forms carbonitrides in grain boundaries. This results in sensitization, which is a phenomenon in which a low-Cr-content regions (Cr-depleted zone) are formed near grain boundaries, and the oxidation resistance of stainless steel is deteriorated. When Ti is deficient relative to C and N, the excess N combines with Al. Thus, the high-temperature-fatigue-resistance-improving effect brought by solid solution strengthening of Al, which is an important effect of the present disclosure, is not obtained. On the other hand, at a Ti content exceeding 0.50%, not only toughness of the steel is deteriorated but also adhesion of oxide scale (cyclic oxidation resistance) is deteriorated. Thus, the Ti content is to be in the range of 5× (C+N)% to 0.50%, preferably in the range of more than 0.15% to 0.40% or less, and more preferably in the range of 0.20% to 0.30%.

Cu: 0.55% to 1.60%

Copper (Cu) is an element very effective for improving the thermal fatigue resistance. This is due to precipitation strengthening of ε-Cu, and in order to obtain this effect in a Ti-containing steel such as one according to the present disclosure, the Cu content needs to be 0.55% or more. On the other hand, Cu deteriorates oxidation resistance and workability, and at a Cu content exceeding 1.60%, ε-Cu becomes coarse and the thermal fatigue resistance is deteriorated. Thus, the Cu content is to be in the range of 0.55% to 1.60% and preferably in the range of 0.7% to 1.3%. However, a sufficient thermal fatigue resistance improving effect is not obtained by only containing Cu. It is necessary to add a small amount of Nb to refine ε-Cu and suppress coarsening of ε-Cu as described above, and to also add B to refine ε-Cu and suppress coarsening of ε-Cu as described below in order for the precipitation strengthening effect to last for a long time. As a result, the thermal fatigue resistance can be improved.

B: 0.0002% to 0.0050%

Boron (B) improves workability, in particular, secondary workability. In a Cu-containing steel such as a steel of the present disclosure, B refines ε-Cu and improves the high-temperature strength, and also has an effect of suppressing coarsening of ε-Cu. Thus, B is an important element for the present disclosure for improving the thermal fatigue resistance. Unless B is contained, ε-Cu tends to be coarse and the thermal fatigue resistance improving effect by containing Cu is not sufficiently obtained. In the present disclosure, B is an important element that also has an effect of improving oxidation resistance, in particular, oxidation resistance in a water vapor atmosphere. These effects can be obtained at a B content of 0.0002% or more. At a B content exceeding 0.0050%, workability and toughness of the steel are deteriorated. Thus, the B content is to be in the range of 0.0002% to 0.0050% and preferably in the range of 0.0005% to 0.0030%.

Ni: 0.05% to 1.0%

Nickel (Ni) is an important element in the present disclosure. Nickel not only improves toughness of the steel but also improves oxidation resistance. In order to obtain these effects, the Ni content needs to be 0.05% or more. If Ni is not contained or is contained in an amount smaller than this range, oxidation resistance that has been deteriorated by containing Cu and Ti cannot be compensated, and sufficient oxidation resistance is not obtained. When oxidation resistance is insufficient, the amount of oxidation increases, resulting in a decrease in the thickness of the base metal, and spalling of oxide scale generates starting points of cracks. Thus, an excellent thermal fatigue resistance is not obtained. On the other hand, Ni is an expensive element and is a strong γ-phase-forming element. At a Ni content exceeding 1.0%, γ phase is formed at high temperature and this deteriorates oxidation resistance. Thus, the Ni content is to be in the range of 0.05% to 1.0%, preferably in the range of 0.10% to 0.50%, and more preferably in the range of 0.15% to 0.30%.

O: 0.0030% or less

Oxygen (O) is an important element for Al-containing steels such as the steel according to the present disclosure.

Oxygen present in the steel preferentially combines with Al in the steel when exposed to high temperature. Due to this combine, the amount of the dissolved Al is decreased and the high-temperature strength is decreased; moreover, Al oxides which form coarse precipitates in the steel serve as starting points of cracks in a high-temperature fatigue test. As a result, an excellent high-temperature fatigue resistance is no longer obtained. When a lot of oxygen is present in the steel, oxygen combines with more Al and thus the amount of the dissolved Al is decreased; moreover, oxygen in the surrounding environment invades into the steel more easily and thus more Al oxides than predicted from the O content of the steel are likely to be formed. Thus, the O content of the steel is preferably as low as possible and is limited to 0.0030% or less. The O content is preferably 0.0020% or less and more preferably 0.0015% or less.

Al/O≥100

As described above, it is critical to decrease the O content in order to improve the high-temperature fatigue resistance of Al-containing steels, such as the Al-containing steel of the present disclosure, through solid solution strengthening caused by Al. The inventors have also carefully studied the effect of the Al/O content ratio on the high-temperature fatigue resistance and found that a particularly excellent high-temperature fatigue resistance is obtained when Al/O≥100 is satisfied as well as Al: 0.20% to 3.0% by mass and 0≤0.0030% by mass. The reason for this is probably as follows. Aluminum (Al) oxides formed of Al combining with O in the steel is not so dense as Al oxides formed as a result of combining of Al with O that has invaded into the steel from the surrounding environment upon exposure to high temperature, and thus do not contribute to improving oxidation resistance as much, thereby allowing invasion of more oxygen into the steel from the surrounding environment and promoting formation of Al oxides, which serve as starting points of cracks. In Al/O, Al and O respectively represent the Al content and the O content.

Basic Test

In the description below, "%" used to describe content of each component of the steel means "% by mass". The basic composition was C: 0.010%, Si: 0.8%, Mn: 0.3%, P: 0.030%, S: 0.002%, Cr: 14%, N: 0.010%, Nb: 0.1%, Ti: 0.25%, Cu: 0.8%, B: 0.0010%, and Ni: 0.20%. The steels in which Al and O were added in various amounts ranging from 0.2% to 2.0% and 0.001% to 0.005% respectively to this basic composition was melted on a laboratory scale and casted into 30 kg steel ingots. Each ingot was heated to 1170° C. and hot-rolled into a sheet bar having a thickness of 35 mm and a width of 150 mm. The sheet bar was heated to 1050° C. and hot-rolled into a hot rolled sheet having a thickness of 5 mm. Subsequently, the hot rolled sheet was annealed at 900° C. to 1050° C. and pickled to prepare a hot rolled and annealed sheet, and the hot rolled and annealed sheet was cold-rolled to a thickness of 2 mm. The resulting cold rolled sheet was finish-annealed at 850° C. to 1050° C. to obtain a cold-rolled and annealed sheet. The cold-rolled and annealed sheet was subjected to a high-temperature fatigue test described below.

High-temperature Fatigue Test

A high-temperature fatigue test specimen having a shape shown in FIG. 1 was prepared from the cold-rolled and annealed sheet obtained as above, and subjected to the high-temperature fatigue test described below.

To a surface of the cold-rolled and annealed sheet, 70 MPa of bending stress was applied at 800° C. and 1300 rpm using a Schenck-type fatigue tester. The number of cycles performed until fracture of the test specimen (number of cycles to fracture) was regarded as the high-temperature fatigue life. Evaluation was based on the following criteria:

Circles (pass): No fracture for $100\times10^5$ cycles.

Triangles (fail): The number of cycles to fracture was $15\times10^5$ or more and less than $100\times10^5$.

Cross marks (fail): The number of cycles to fracture was less than $15\times10^5$.

Figure 4:
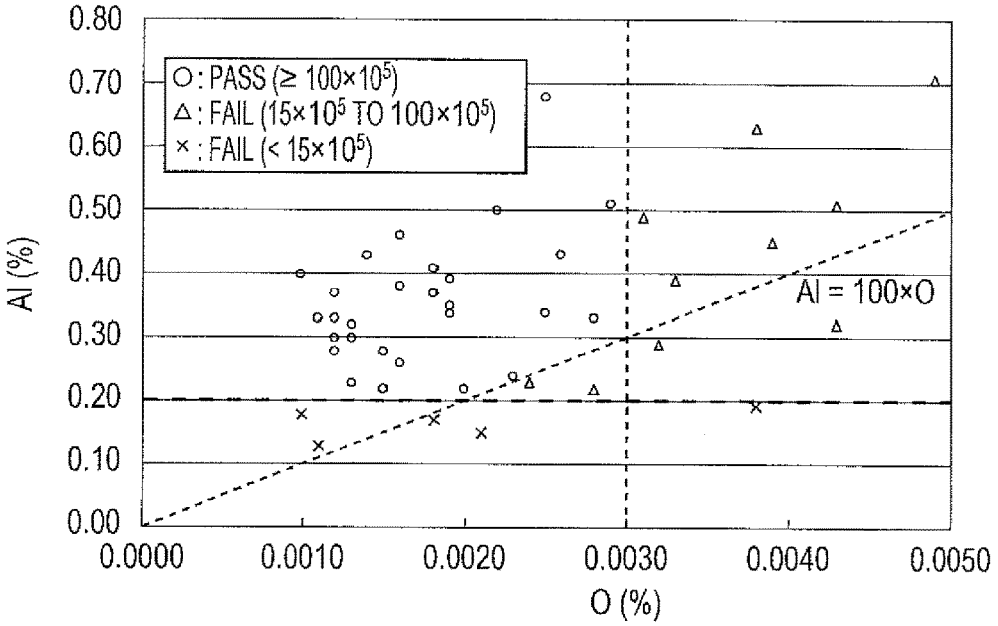
FIG. 4 is a diagram illustrating the influence of the Al content and the O content on the high-temperature fatigue resistance.

FIG. 4 shows the results of the high-temperature fatigue test. FIG. 4 demonstrates that a particularly excellent high-temperature fatigue life is obtained when O content is 0.0030% or less, the Al content is 0.20% or more, and Al/O≥100. The "O (%)" in the horizontal axis indicates the O content and the "Al (%)" in the vertical axis indicates the Al content.

The components described above are essential components of the ferritic stainless steel according to the present disclosure. In addition to these components, at least one element selected from REM, Zr, V, and Co may be added as the optional element (optional component) in order to improve the heat resistance.

REM: 0.005% to 0.08%, Zr: 0.01% to 0.50%

A rare earth element (REM) and Zr are both an element that improves oxidation resistance. The stainless steel according to the present disclosure may contain these elements if necessary. In order to obtain the above-described effect, the REM content is preferably 0.005% or more and the Zr content is preferably 0.01% or more. At a REM content exceeding 0.08%, the steel becomes brittle. At a Zr content exceeding 0.50%, Zr intermetallic compounds are precipitated and the steel becomes brittle. Thus, if a REM is to be contained, the REM content is to be 0.0005% to 0.08% or less. If Zr is to be contained, the Zr content is to be 0.01% to 0.50% or less.

V: 0.01% to 0.50%

Vanadium (V) has an effect of improving not only high-temperature strength but also oxidation resistance. Vanadium also has an effect of suppressing coarsening of Ti carbonitrides, which adversely affect the high-temperature fatigue resistance and toughness by forming starting points of cracks or the like if coarsened. In order to obtain these effects, the V content is preferably 0.01% or more. At a V content exceeding 0.50%, coarse V(C, N) are precipitated and toughness is deteriorated. Thus, if V is to be contained, the V content is to be in the range of 0.01% to 0.50%. The V content is preferably in the range of 0.03% to 0.40% and more preferably in the range of 0.05% to 0.25%.

Co: 0.01% to 0.50%

Cobalt (Co) is an element effective for improving toughness and is also an element that improves high-temperature strength. In order to obtain these effects, the Co content is preferably 0.01% or more. However, Co is an expensive element and the effects are saturated beyond a Co content of 0.50%. Thus, if Co is to be contained, the Co content is to be in the range of 0.01% to 0.50% and preferably in the range of 0.02% to 0.20%.

From the viewpoint of improving workability and manufacturability, at least one element selected from Ca and Mg may be further contained as the optional element within the range described below.

Ca: 0.0005% to 0.0030%

Calcium (Ca) is a component effective for preventing clogging of nozzles caused by precipitation of Ti-based inclusions that are likely to occur during continuous casting. This effect is obtained at a Ca content of 0.0005% or more. In order to obtain a satisfactory surface property without causing surface defects, the Ca content needs to be 0.0030% or less. Thus, if Ca is to be contained, the Ca content is to be in the range of 0.0005% to 0.0030%. The Ca content is preferably in the range of 0.0005% to 0.0020% and more preferably in the range of 0.0005% to 0.0015%.

Mg: 0.0010% to 0.0030%

Magnesium (Mg) is an element that improves the equiaxed crystal ratio of a slab and is effective for improving workability and toughness. For Ti-containing steels such as the steel of the present disclosure, Mg also has an effect of suppressing coarsening of Ti carbonitrides. These effects are obtained when the Mg content is 0.0010% or more. When Ti carbonitrides become coarse, starting points for brittle cracking are formed and the toughness of the steel is significantly deteriorated. However, at a Mg content exceeding 0.0030%, the surface property of the steel is degraded. Thus, if Mg is to be contained, the Mg content is to be in the range of 0.0010% to 0.0030%. The Mg content is preferably in the range of 0.0010% to 0.0020% and more preferably in the range of 0.0010% to 0.0015%.

From the viewpoint of improving the heat resistance, Mo may be contained as the optional element within the range described below.

Mo: 0.05% to 1.0% or less

Molybdenum (Mo) is an element that improves the heat resistance by significantly increasing the strength of the steel through solid solution strengthening. Molybdenum also has an effect of improving high-temperature salt corrosion resistance. These effects are obtained at a Mo content of 0.05% or more. However, Mo is an expensive element and deteriorates oxidation resistance of steels that contain Ti, Cu, and Al, such as the steel of the present disclosure. Therefore, if Mo is to be contained, the upper limit of the Mo content is to be 1.0%. Thus, if Mo is to be contained, the Mo content is to be in the range of 0.05% to 1.0%. The Mo content is preferably 0.10% to 0.50% or less.

The balance of the essential elements and optional elements is Fe and unavoidable impurities.

Next, a method for producing a ferritic stainless steel according to the present disclosure is described.

Basically, the method for producing a stainless steel according to the present disclosure may be any common method for producing a ferritic stainless steel and is not particularly limited. However, in order to decrease the O content of the steel, which is critical to the present disclosure, production conditions are controlled in the refining step described below. An example of the production method is as follows. First, a molten steel is produced in a known melting furnace, such as a converter or an electric furnace, and optionally further subjected to secondary refining such as ladle refining or vacuum refining, to prepare a steel having the composition of the present disclosure described above. During this process, the amount of O, which is an important element in the present disclosure, needs to be sufficiently decreased. Merely adding Al may not sufficiently decrease the O content of the steel. For example, if the basicity ($CaO/Al_2O_3$) of the slag generated is small, the equilibrium oxygen concentration is increased and the O content of the steel is increased. When the molten steel after vacuum refining is exposed to air for a long time, oxygen from the air may invade into the steel. Thus, in producing the steel developed in the present disclosure, the basicity of the slag is controlled to be large, and the time for which the molten steel after vacuum refining is held open to air is shortened as much as possible. Then the molten steel is formed into a slab by a continuous casting method or an ingoting-slabbing method. Then steps such as hot rolling, hot-rolled-sheet annealing, pickling, cold rolling, finish annealing, and pickling are preferably performed in that order to form a cold rolled and annealed sheet from the slab.

The cold rolling may be performed once, or two or more times with intermediate annealing performed in between. The steps of cold rolling, finish annealing, and pickling may be repeated.

In some cases, the hot-rolled-sheet annealing may be omitted. If the steel is required to have a glossy surface, skin-pass rolling may be performed after cold rolling or finish annealing.

A more preferable production method involves specifying at least one of the conditions of performing hot rolling and performing cold rolling. The preferable production conditions are described below.

In steel making, a molten steel containing the essential components and optional components added as necessary is prepared in a converter, an electric furnace, or the like, and subjected to secondary refining by a vacuum oxygen decarburization (VOD) method preferably. The refined molten steel can be formed into a steel material through a known production method; however, from the viewpoints of productivity and quality, a continuous casting method is preferably performed.

The steel material obtained by continuous casting is heated to, for example, 1000° C. to 1250° C. and hot-rolled into a hot rolled sheet having a desired thickness. The thickness of the hot rolled sheet is not particularly limited but is preferably about 4 mm or more and 6 mm or less. Naturally, the steel material may be worked into any form other than the sheet. The hot rolled sheet is continuously annealed at 850° C. to 1100° C., if needed, and then descaled by pickling or the like. As a result, a hot rolled sheet product is obtained. If needed, scale may be removed by shot blasting prior to pickling.

In order to obtain a cold rolled and annealed sheet, the hot rolled and annealed sheet obtained as above is cold rolled to prepare a cold rolled sheet. The thickness of the cold rolled and annealed sheet is not particularly limited but is preferably about 1 mm or more and 3 mm or less. During the cold rolling process, cold rolling may be performed two or more times including intermediate annealing as needed according to the convenience of production. The total reduction in the cold rolling step that includes performing cold rolling once or more than once is 60% or more and preferably 70% or more.

The cold rolled sheet is subjected to continuous annealing (finish annealing) at an annealing temperature of 850° C. to 1150° C. and preferably at 850° C. to 1050° C., and then to pickling. As a result, a cold-rolled and annealed sheet is obtained. Depending on the usage, the pickled sheet may be lightly rolled (skin-pass rolling, for example) to adjust the shape and quality of the steel sheet.

The hot rolled sheet product or the cold-rolled and annealed sheet product prepared as described above is subjected to bending or the like depending on the usage so as to form exhaust pipes and catalyst cases of automobiles and motorcycles, exhaust ducts of thermal power plants, and parts (for example, separators, interconnectors, and reformers) related to fuel cells.

The welding method for these parts is not particularly limited. Common arc welding methods such as metal inert gas (MIG), metal active gas (MAG), and tungsten inert gas (TIG) welding methods, resistance welding methods such as spot welding and seam welding, and high-frequency resistance welding and high-frequency inductive welding such as an electric welding method can be applied.

EXAMPLES

Steels having compositions shown in Table 1 (Tables 1-1, 1-2, and 1-3 are generally referred to as Table 1) were each melted in a vacuum melting furnace and cast to form a 30 kg steel ingot.

The steel ingot was heated to 1170° C. and hot-rolled into a sheet bar having a thickness of 35 mm and a width of 150 mm, The sheet bar was halved and one of the halves was heated to 1050° C. and hot-rolled into a hot rolled sheet having a thickness of 5 mm. The hot rolled sheet was annealed at 900° C. to 1050° C. and pickled to form a hot-rolled and annealed sheet, and the hot-rolled and annealed sheet was cold-rolled to a thickness of 2 mm. The cold rolled sheet was finish-annealed at 850° C. to 1050° C. to form a cold-rolled and annealed sheet, which was used in a high-temperature fatigue test described below.

High-Temperature Fatigue Test

A fatigue test specimen having a shape shown in FIG. 1 was prepared from the cold-rolled and annealed sheet obtained as described above and subjected to a high-temperature fatigue test described below.

A bending stress of 70 MPa was applied to a surface of the cold-rolled and annealed sheet by using a Schenck-type fatigue tester at 800° C. and 1300 rpm. The number of cycles performed until fracture of the test specimen (number of cycles to fracture) was assumed to be the high-temperature fatigue life, which was evaluated based on the following criteria:

Circles (pass): No fracture for $100\times10^5$ cycles.

Triangles (fail): The number of cycles to fracture was $15\times10^5$ or more and less than $100\times10^5$.

Cross marks (fail): The number of cycles to fracture was less than $15\times10^5$.

Continuous Oxidation Test in Air

A 30 mm×20 mm sample was cut out from each of the cold-rolled and annealed sheets obtained as described above. A hole 4 mm in diameter was formed in an upper portion of the sample. Surfaces and end surfaces of the sample were polished with a #320 emery paper, and the sample was degreased. The degreased sample was suspended in an air atmosphere inside a furnace heated to and retained at 1000° C., and left suspended for 300 hours. After the testing, the mass of the sample was measured, and the difference from the mass before testing measured in advance was determined, thereby the oxidation-induced weight gain ($g/m^2$) being calculated. The test was conducted twice for each and oxidation resistance was evaluated according to the following criteria: samples whose the oxidation-induced weight gain was less than 50 $g/m^2$ both times were rated pass (indicated by circles) and samples whose the oxidation-induced weight gain was 50 $g/m^2$ or more at least once were rated fail (indicated by cross marks).

Cyclic Oxidation Test in Air

The same type of the test specimen as that used in the continuous oxidation test in air described above was subjected to 400 cycles of a heat treatment that included repetition of heating and cooling, each cycle including holding 100° C. for 1 minute and holding 1000° C. for 20 minutes in air. The difference in mass of the test specimen between before and after the test was measured. The weight gain by oxidation per unit area ($g/m^2$) was calculated and the absence or presence of scale separating from the test specimen surface (spalling of scale) was checked. Samples in which spalling of scale was observed were rated fail (indicated by cross marks in Table 1), and samples in which spalling of scale was not observed were rated pass (indicated by circles in Table 1). In the test, the heating rate and the cooling rate were, respectively, 5 ° C./sec and 1.5 ° C./sec.

Figure 2:
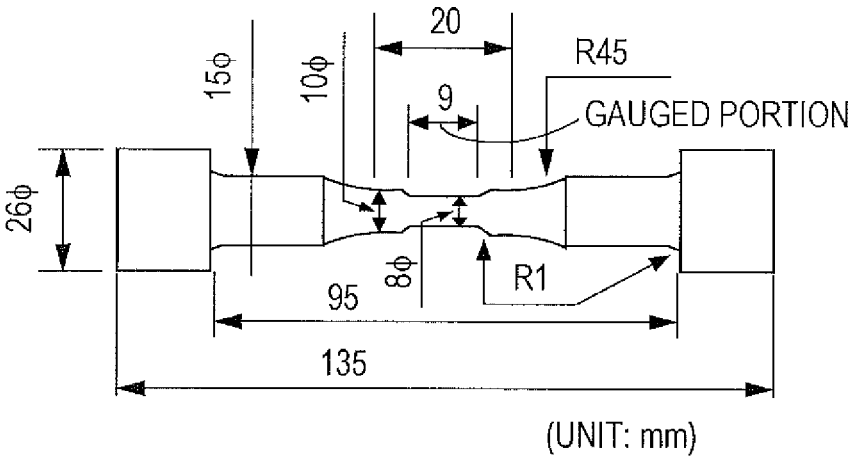
FIG. 2 is a diagram illustrating a thermal fatigue test specimen.

Thermal Fatigue Test The other half of the 30kg steel ingot was heated to 1170° C. and hot-rolled into a sheet bar having a thickness of 30 mm and a width of 150 mm. The sheet bar was forged into a 35 mm square bar, annealed at a temperature of 1030° C., and machined into a thermal fatigue test specimen having a shape and dimensions shown in FIG. 2. The test specimen was used in the thermal fatigue test described below.

Figure 3:
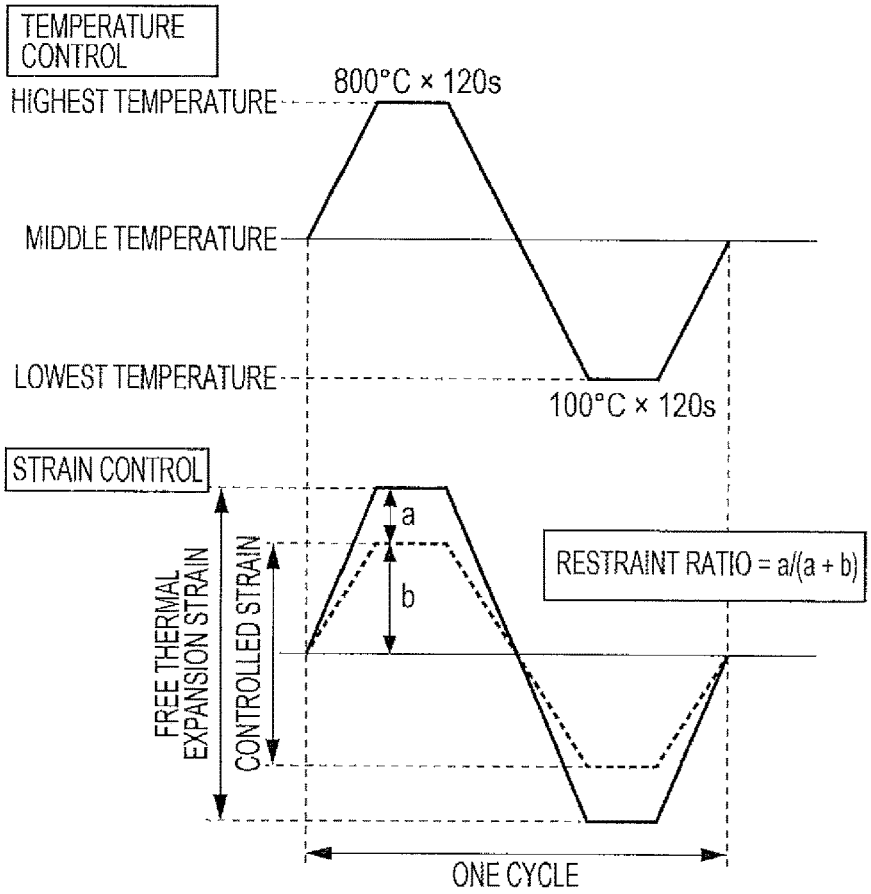
FIG. 3 is a diagram illustrating thermal fatigue test conditions (temperature and restraint conditions).

As indicated in FIG. 3, the thermal fatigue test was conducted by repeating heating and cooling between 100° C. and 800° C. while restraining the test specimen at a restraint ratio of 0.5. The holding time at 100° C. and 800° C. was 2 min each. The thermal fatigue lifetime was determined as follows: stress was calculated by dividing the load detected at 100° C. by the cross-sectional area of the gauged portion of the specimen (refer to FIG. 2); the number of cycles taken for the stress to decrease to 75% of the stress at the initial stage of the test (fifth cycle) was counted; and the counted number was regarded as the thermal fatigue lifetime. The thermal fatigue resistance was evaluated pass (indicated by circles) when the number of cycles was 910 or more and evaluated fail (indicated by cross marks) when the number of cycles was less than 910.

The results are summarized in Table 1.

TABLE 1

| | Composition (% by mass)* | | | | | | | | | | | | | |
|---|---|---|---|---|---|---|---|---|---|---|---|---|---|---|
| No. | C | Si | Mn | Al | P | S | Cr | Ni | Cu | Ti | Nb | N | B | O |
| 1 | 0.007 | 0.83 | 0.19 | 0.37 | 0.021 | 0.002 | 14.3 | 0.18 | 0.76 | 0.26 | 0.09 | 0.012 | 0.0010 | 0.0018 |
| 2 | 0.006 | 0.52 | 0.32 | 0.38 | 0.031 | 0.001 | 10.4 | 0.08 | 0.74 | 0.20 | 0.10 | 0.006 | 0.0010 | 0.0016 |
| 3 | 0.011 | 0.56 | 0.12 | 0.28 | 0.036 | 0.002 | 10.7 | 0.28 | 1.36 | 0.27 | 0.05 | 0.009 | 0.0005 | 0.0012 |
| 4 | 0.007 | 0.78 | 0.38 | 0.33 | 0.036 | 0.002 | 14.7 | 0.24 | 1.00 | 0.18 | 0.10 | 0.009 | 0.0026 | 0.0011 |
| 5 | 0.011 | 0.92 | 1.88 | 0.24 | 0.039 | 0.001 | 11.6 | 0.25 | 0.71 | 0.31 | 0.01 | 0.007 | 0.0012 | 0.0023 |
| 6 | 0.010 | 0.90 | 0.09 | 0.23 | 0.038 | 0.002 | 10.4 | 0.66 | 0.76 | 0.21 | 0.15 | 0.007 | 0.0029 | 0.0013 |
| 7 | 0.010 | 0.94 | 0.98 | 0.46 | 0.039 | 0.002 | 12.6 | 0.16 | 1.05 | 0.23 | 0.08 | 0.009 | 0.0021 | 0.0016 |
| 8 | 0.011 | 0.56 | 0.45 | 2.04 | 0.024 | 0.002 | 13.1 | 0.91 | 0.96 | 0.25 | 0.05 | 0.009 | 0.0024 | 0.0018 |
| 9 | 0.008 | 2.93 | 0.18 | 0.41 | 0.023 | 0.003 | 16.0 | 0.22 | 0.70 | 0.31 | 0.02 | 0.011 | 0.0020 | 0.0018 |
| 10 | 0.006 | 0.88 | 0.24 | 0.34 | 0.020 | 0.001 | 13.7 | 0.13 | 1.56 | 0.26 | 0.06 | 0.012 | 0.0014 | 0.0025 |
| 11 | 0.008 | 0.67 | 0.33 | 0.33 | 0.030 | 0.002 | 18.8 | 0.12 | 1.47 | 0.18 | 0.06 | 0.010 | 0.0006 | 0.0012 |
| 12 | 0.011 | 0.48 | 0.47 | 0.22 | 0.023 | 0.002 | 10.4 | 0.13 | 1.42 | 0.30 | 0.14 | 0.009 | 0.0011 | 0.0015 |
| 13 | 0.009 | 0.69 | 0.15 | 0.26 | 0.033 | 0.002 | 18.3 | 0.25 | 0.93 | 0.28 | 0.05 | 0.008 | 0.0023 | 0.0016 |
| 14 | 0.011 | 0.55 | 0.33 | 0.37 | 0.028 | 0.003 | 13.5 | 0.06 | 1.18 | 0.28 | 0.10 | 0.009 | 0.0022 | 0.0012 |
| 15 | 0.012 | 0.58 | 0.39 | 0.35 | 0.029 | 0.002 | 18.0 | 0.17 | 1.13 | 0.21 | 0.02 | 0.005 | 0.0026 | 0.0019 |

TABLE 1-continued

| | | | | | | | | | | | | | | |
|---|---|---|---|---|---|---|---|---|---|---|---|---|---|---|
| 16 | 0.011 | 0.53 | 0.36 | 0.39 | 0.023 | 0.002 | 18.2 | 0.11 | 1.02 | 0.30 | 0.14 | 0.006 | 0.0021 | 0.0019 |
| 17 | 0.010 | 0.87 | 0.11 | 0.32 | 0.031 | 0.003 | 10.3 | 0.30 | 1.53 | 0.20 | 0.04 | 0.010 | 0.0009 | 0.0013 |
| 18 | 0.007 | 0.40 | 0.32 | 0.28 | 0.031 | 0.002 | 10.8 | 0.14 | 1.33 | 0.22 | 0.04 | 0.008 | 0.0027 | 0.0015 |
| 19 | 0.010 | 0.76 | 0.11 | 0.30 | 0.027 | 0.002 | 12.4 | 0.05 | 1.27 | 0.26 | 0.07 | 0.011 | 0.0012 | 0.0013 |
| 20 | 0.005 | 0.79 | 0.20 | 0.30 | 0.031 | 0.001 | 16.8 | 0.14 | 1.04 | 0.19 | 0.02 | 0.008 | 0.0021 | 0.0012 |
| 21 | 0.006 | 0.85 | 0.40 | 0.43 | 0.036 | 0.003 | 13.3 | 0.13 | 0.82 | 0.18 | 0.04 | 0.010 | 0.0026 | 0.0014 |
| 22 | 0.005 | 0.63 | 0.16 | 0.40 | 0.033 | 0.001 | 12.0 | 0.24 | 1.27 | 0.31 | 0.09 | 0.010 | 0.0005 | 0.0010 |
| 23 | 0.005 | 0.60 | 0.26 | 0.34 | 0.039 | 0.002 | 14.1 | 0.12 | 1.43 | 0.25 | 0.02 | 0.009 | 0.0008 | 0.0019 |
| 24 | 0.011 | 0.75 | 0.09 | 0.38 | 0.034 | 0.001 | 13.6 | 0.11 | 1.10 | 0.26 | 0.05 | 0.010 | 0.0017 | 0.0016 |
| 25 | 0.011 | 0.54 | 0.23 | 0.34 | 0.020 | 0.002 | 11.5 | 0.27 | 0.64 | 0.31 | 0.13 | 0.008 | 0.0015 | 0.0019 |

| | Composition (% by mass)* | | | | | | |
|---|---|---|---|---|---|---|---|
| No. | V | Zr | Co | REM | Mo | Ca | Mg |
| 1 | | | | | | | |
| 2 | | | | | | | |
| 3 | | | | | | | |
| 4 | | | | | | | |
| 5 | | | | | | | |
| 6 | | | | | | | |
| 7 | | | | | | | |
| 8 | | | | | | | |
| 9 | | | | | | | |
| 10 | | | | | | | |
| 11 | 0.04 | | | | | | |
| 12 | 0.27 | | | | | | |
| 13 | | 0.06 | | | | | |
| 14 | | | 0.03 | | | | |
| 15 | | | 0.26 | | | | |
| 16 | | | | 0.04 | | | |
| 17 | | | | | 0.11 | | |
| 18 | | | | | 0.78 | | |
| 19 | | | | | | 0.0012 | |
| 20 | | | | | | | 0.0017 |
| 21 | | | | | | 0.0014 | 0.0016 |
| 22 | 0.09 | | 0.14 | | | 0.0013 | 0.0014 |
| 23 | 0.33 | | | | 0.28 | | |
| 24 | | | | | 0.32 | 0.002 | 0.0017 |
| 25 | | | 0.09 | | | 0.0018 | 0.002 |

| | Composition (% by mass)* | | | | | | | | | | | | | |
|---|---|---|---|---|---|---|---|---|---|---|---|---|---|---|
| No. | C | Si | Mn | Al | P | S | Cr | Ni | Cu | Ti | Nb | N | B | O |
| 26 | 0.012 | 0.71 | 0.15 | 0.21 | 0.023 | 0.001 | 12.9 | 0.12 | 0.43 | 0.31 | 0.02 | 0.009 | 0.0013 | 0.0011 |
| 27 | 0.009 | 0.40 | 0.21 | 0.43 | 0.029 | 0.002 | 11.3 | 0.27 | 0.64 | 0.09 | 0.06 | 0.011 | 0.0019 | 0.0012 |
| 28 | 0.010 | 0.56 | 0.43 | 0.24 | 0.029 | 0.001 | 11.0 | 0.03 | 1.07 | 0.19 | 0.13 | 0.009 | 0.0022 | 0.0029 |
| 29 | 0.006 | 0.94 | 0.48 | 0.13 | 0.039 | 0.002 | 19.2 | 0.21 | 0.79 | 0.25 | 0.07 | 0.010 | 0.0018 | 0.0011 |
| 30 | 0.006 | 0.81 | 0.45 | 0.51 | 0.037 | 0.002 | 18.4 | 0.07 | 1.06 | 0.26 | 0.14 | 0.007 | 0.0023 | 0.0043 |
| 31 | 0.011 | 0.61 | 0.37 | 0.22 | 0.022 | 0.002 | 17.8 | 0.27 | 0.56 | 0.27 | 0.03 | 0.012 | 0.0008 | 0.0028 |
| 32 | 0.005 | 0.75 | 0.25 | 0.26 | 0.038 | 0.002 | 12.8 | 0.05 | 0.64 | 0.21 | — | 0.006 | 0.0014 | 0.0012 |
| 33 | 0.009 | 0.57 | 0.40 | 0.63 | 0.026 | 0.002 | 15.1 | 0.27 | 1.24 | 0.26 | 0.04 | 0.010 | 0.0026 | 0.0038 |
| 34 | 0.007 | 0.85 | 0.39 | 0.71 | 0.033 | 0.003 | 19.7 | 0.23 | 1.46 | 0.31 | 0.12 | 0.007 | 0.0017 | 0.0049 |
| 35 | 0.011 | 0.59 | 0.11 | 0.23 | 0.033 | 0.002 | 15.3 | 0.27 | 1.39 | 0.20 | 0.08 | 0.009 | 0.0013 | 0.0024 |
| 36 | 0.008 | 3.06 | 0.25 | 0.48 | 0.030 | 0.002 | 14.6 | 0.19 | 1.31 | 0.25 | 0.04 | 0.010 | 0.0011 | 0.0010 |
| 37 | 0.011 | 0.77 | 2.11 | 0.42 | 0.029 | 0.002 | 17.7 | 0.09 | 0.80 | 0.24 | 0.05 | 0.008 | 0.0013 | 0.0012 |
| 38 | 0.009 | 0.48 | 0.33 | 3.18 | 0.028 | 0.002 | 12.5 | 0.30 | 1.02 | 0.30 | 0.09 | 0.012 | 0.0013 | 0.0009 |
| 39 | 0.010 | 0.91 | 0.18 | 1.48 | 0.028 | 0.001 | 8.9 | 0.27 | 0.93 | 0.19 | 0.03 | 0.009 | 0.0009 | 0.0018 |
| 40 | 0.011 | 1.06 | 0.50 | 0.53 | 0.030 | 0.002 | 16.0 | 1.05 | 1.55 | 0.22 | 0.06 | 0.010 | 0.0018 | 0.0020 |
| 41 | 0.008 | 0.85 | 0.22 | 0.31 | 0.031 | 0.003 | 15.4 | 0.35 | 1.77 | 0.28 | 0.10 | 0.011 | 0.0020 | 0.0017 |
| 42 | 0.010 | 0.88 | 0.41 | 0.39 | 0.029 | 0.002 | 14.3 | 0.26 | 1.33 | 0.24 | 0.11 | 0.012 | — | 0.0019 |
| 43 | 0.009 | 0.48 | 0.30 | 0.31 | 0.03 | 0.002 | 14.6 | 0.16 | 1.27 | 0.22 | 0.05 | 0.012 | 0.0018 | 0.0036 |

| No. | 5*(C + N) (% by mass) | Ti/ (C + N) | Al/O | Thermal fatigue lifetime | Continuous oxidation | Cyclic oxidation | Number of cycles to fracture a high-temperature fatigue test | Note |
|---|---|---|---|---|---|---|---|---|
| 1 | 0.095 | 13.7 | 206 | ○ | ○ | ○ | ○ | Example |
| 2 | 0.060 | 16.7 | 238 | ○ | ○ | ○ | ○ | Example |
| 3 | 0.100 | 13.5 | 233 | ○ | ○ | ○ | ○ | Example |
| 4 | 0.080 | 11.3 | 300 | ○ | ○ | ○ | ○ | Example |
| 5 | 0.090 | 17.2 | 104 | ○ | ○ | ○ | ○ | Example |
| 6 | 0.085 | 12.4 | 177 | ○ | ○ | ○ | ○ | Example |
| 7 | 0.095 | 12.1 | 288 | ○ | ○ | ○ | ○ | Example |
| 8 | 0.100 | 12.5 | 1133 | ○ | ○ | ○ | ○ | Example |
| 9 | 0.095 | 16.3 | 228 | ○ | ○ | ○ | ○ | Example |

TABLE 1-continued

| | | | | | | | | |
|---|---|---|---|---|---|---|---|---|
| 10 | 0.090 | 14.4 | 136 | ○ | ○ | ○ | ○ | Example |
| 11 | 0.090 | 10.0 | 275 | ○ | ○ | ○ | ○ | Example |
| 12 | 0.100 | 15.0 | 147 | ○ | ○ | ○ | ○ | Example |
| 13 | 0.085 | 16.5 | 163 | ○ | ○ | ○ | ○ | Example |
| 14 | 0.100 | 14.0 | 308 | ○ | ○ | ○ | ○ | Example |
| 15 | 0.085 | 12.4 | 184 | ○ | ○ | ○ | ○ | Example |
| 16 | 0.085 | 17.6 | 205 | ○ | ○ | ○ | ○ | Example |
| 17 | 0.100 | 10.0 | 246 | ○ | ○ | ○ | ○ | Example |
| 18 | 0.075 | 14.7 | 187 | ○ | ○ | ○ | ○ | Example |
| 19 | 0.105 | 12.4 | 231 | ○ | ○ | ○ | ○ | Example |
| 20 | 0.065 | 14.6 | 250 | ○ | ○ | ○ | ○ | Example |
| 21 | 0.080 | 11.3 | 307 | ○ | ○ | ○ | ○ | Example |
| 22 | 0.075 | 20.7 | 400 | ○ | ○ | ○ | ○ | Example |
| 23 | 0.070 | 17.9 | 179 | ○ | ○ | ○ | ○ | Example |
| 24 | 0.105 | 12.4 | 238 | ○ | ○ | ○ | ○ | Example |
| 25 | 0.095 | 16.3 | 179 | ○ | ○ | ○ | ○ | Example |
| 26 | 0.105 | 14.8 | 191 | x | ○ | ○ | x | Comparative Example |
| 27 | 0.100 | 4.5 | 358 | ○ | x | x | x | Comparative Example |
| 28 | 0.095 | 10.0 | 83 | ○ | ○ | ○ | Δ | Comparative Example |
| 29 | 0.080 | 15.6 | 118 | ○ | x | x | x | Comparative Example |
| 30 | 0.065 | 20.0 | 119 | ○ | ○ | ○ | Δ | Comparative Example |
| 31 | 0.115 | 11.7 | 79 | ○ | ○ | ○ | Δ | Comparative Example |
| 32 | 0.055 | 19.1 | 217 | x | ○ | ○ | x | Comparative Example |
| 33 | 0.095 | 13.7 | 166 | ○ | ○ | ○ | Δ | Comparative Example |
| 34 | 0.070 | 22.1 | 145 | ○ | ○ | ○ | Δ | Comparative Example |
| 35 | 0.100 | 10.0 | 96 | ○ | ○ | ○ | Δ | Comparative Example |
| 36 | 0.090 | 13.9 | 480 | ○ | ○ | x | ○ | Comparative Example |
| 37 | 0.095 | 12.6 | 350 | x | x | x | x | Comparative Example |
| 38 | 0.105 | 14.3 | 3533 | ○ | ○ | ○ | x | Comparative Example |
| 39 | 0.095 | 10.0 | 822 | ○ | x | x | ○ | Comparative Example |
| 40 | 0.105 | 10.5 | 265 | x | x | x | x | Comparative Example |
| 41 | 0.095 | 14.7 | 182 | x | ○ | ○ | ○ | Comparative Example |
| 42 | 0.110 | 10.9 | 205 | x | ○ | ○ | ○ | Comparative Example |
| 43 | 0.105 | 10.5 | 67 | ○ | ○ | ○ | Δ | Comparative Example |

Note:
*Underlined items are outside the scope of the present disclosure.

Table 1 clearly shows that the examples of the present disclosure exhibit an excellent thermal fatigue resistance and an excellent oxidation resistance, as well as a particularly excellent high-temperature fatigue resistance. The results confirm that the object of the present disclosure is achieved.

INDUSTRIAL APPLICABILITY

The steel according to the present disclosure is suitable for use not only in exhaust parts of automobiles but also in exhaust parts of thermal power plants and solid oxide-type fuel cell parts that require similar properties.

The invention claimed is:

1. A ferritic stainless steel comprising:
C: 0.020% or less, by mass %;
Si: 3.0% or less, by mass %;
Mn: 2.0% or less, by mass %;
P: 0.040% or less, by mass %;
S: 0.030% or less, by mass %;
Cr: 10.0% to 20.0%, by mass %;
N: 0.020% or less, by mass %:
Nb: 0.005% to 0.15%, by mass %;
Al: 0.20% to 3.0%, by mass %;
Ti: 5×(C +N)% to 0.50%, by mass %,
wherein 5×(C +N), C and N respectively represent a carbon content and a nitrogen content (by mass %);
Cu: 0.55% to 1.60%, by mass %;
B: 0.0002% to 0.0050%, by mass %;
Ni: 0.05% to 1.0%, by mass %;
O: 0.0030% or less, by mass %; and
the balance being Fe and unavoidable impurities,
wherein Al/O≥100,
wherein Al/O, Al and O respectively represent an aluminum content and an oxygen content (by mass %).

2. The ferritic stainless steel according to claim 1, further comprising at least one element selected from the group consisting of REM: 0.005% to 0.08%, by mass %; Zr: 0.01% to 0.50%, by mass %; V: 0.01% to 0.50%, by mass %; and Co: 0.01% to 0.50%, by mass %.

3. The ferritic stainless steel according to claim 1, further comprising at least one element selected from the group consisting of Ca: 0.0005% to 0.0030%, by mass %; and Mg: 0.0010% to 0.0030%, by mass %.

4. The ferritic stainless steel according to claim 2, further comprising at least one element selected from the group consisting of Ca: 0.0005% to 0.0030%, by mass %; and Mg: 0.0010% to 0.0030%, by mass %.

5. The ferritic stainless steel according to claim 1, further comprising Mo: 0.05% to 1.0%, by mass %.

6. The ferritic stainless steel according to claim 2, further comprising Mo: 0.05% to 1.0%, by mass %.

7. The ferritic stainless steel according to claim 3, further comprising Mo: 0.05% to 1.0%, by mass %.

8. The ferritic stainless steel according to claim 4, further comprising Mo: 0.05% to 1.0%, by mass %.

* * * * *